United States Patent [19]

Trank

[11] 4,047,784

[45] Sept. 13, 1977

[54] TAP SPLICE CONNECTOR

[75] Inventor: Robert D. Trank, Pompano Beach, Fla.

[73] Assignee: Hollingsworth Solderless Terminal Company, Phoenixville, Pa.

[21] Appl. No.: 755,037

[22] Filed: Dec. 28, 1976

[51] Int. Cl.[2] ..... H01R 9/08
[52] U.S. Cl. ..... 339/98
[58] Field of Search ..... 339/97–99

[56] References Cited

U.S. PATENT DOCUMENTS

| | | | |
|---|---|---|---|
| 3,372,361 | 3/1968 | Wengen | 339/97 R |
| 3,836,944 | 9/1974 | Lawson | 339/99 R |

*Primary Examiner*—Joseph H. McGlynn
*Attorney, Agent, or Firm*—Jackson, Jackson & Chovanes

[57] ABSTRACT

A wire connector having an insulating body of S-shaped cross section wherein the bends of the S form wire-receiving channels. A pair of hinged and latched covers keep the wires in the channels. A metal contact plate is supported in the body and electrically connects the wires.

2 Claims, 5 Drawing Figures

TAP SPLICE CONNECTOR

FIELD OF INVENTION

This invention relates to a solderless connector of the type used to electrically and mechanically connect two insulated wires. Such connectors have an insulating body with longitudinal wire-receiving channels therein.

A metal slotted contact plate extends across the channels and shears the insulation when the wires are forced into the channels. The metal plate contacts the wire conductors. A cover holds the wires in place. Examples of such prior art connectors are seen in U.S. Pat. Nos. 2,587,239; 3,793,611 and 3,858,157.

BACKGROUND OF INVENTION

Prior art connectors as described above have required substantial force to be exerted against the cover to force the wires into the contact element slots and shear the wire insulation. Such force had to be exerted simultaneously against both wires that were being joined.

A tool such as a pair of pliers had to be used to provide the necessary mechanical advantage to force the cover into a locked position, whereby the insulation of the wires was sheared and the contact plate bore against the wire conductor.

The present invention substantially reduces the amount of force necessary to force the cover into a locked position. It does this by having an individual cover acting on one wire at a time, and by hinging the cover and positioning the wire close to the hinge, within the body, whereby a substantial leverage action is obtained against the individual wire in forcing it into the contact plate.

Additionally, the present invention provides for relatively easy latching and unlatching of each of the covers. This provides for an easier connect and disconnect.

Furthermore, by providing an independent connection for each of the wires, the connector is more easily used than those of the prior art, since it is only necessary for the operator to support one wire at a time within the connector during the connecting operation.

The present invention further provides a firm mechanical support for each of the wires since each channel is formed in its own pocket which extends completely around three sides of the wire. The cover securely keeps the wire within such channel by closing off the top opening of the channel.

SUMMARY OF INVENTION

The body of a connector is formed in a S-shaped cross section whereby a pocket, or channel, is formed in the interior of each of the opposite bends of the S. A cover is pivoted on each end of the S and swings from an open position wherein the pocket of the S is accessible for inserting or removing a wire, to a closed position wherein the cover at the end opposite the hinge lies adjacent the exterior of the bend opposite the hinge and is latched thereto. One each of the two covers is hinged from each end of the S. A contact plate is positioned in the body in the transverse plane, with portions of the contact plate extending into each pocket or groove. A slot, having sharpened or unsharpened edges, of a width substantially narrower than the diameter of the insulation on the wire, but wide enough to permit the entry of the wire conductor whereby the plate bears against the conductor but does not shear it, receives an insulated wire. The insulated wire is forced into the slot of the metallic plate by an individual hinged cover for each pocket. The cover is hinged at the end of the S and in a closed position latches onto the exterior of the opposite bend.

The invention provides for a substantial mechanical advantage in forcing the wire against and into the slot of the bearing plate since the pocket or groove receiving the wire is adjacent the pivot point or hinge point of the cover. The cover is latched onto the opposite bend of the S, away from the pivot point of the cover.

The wire can be readily removed from the connector by unlatching and swinging open the cover, and removing the wire from the pocket of the conductor.

DESCRIPTION OF THE PREFERRED EMBODIMENT

Figure 1:
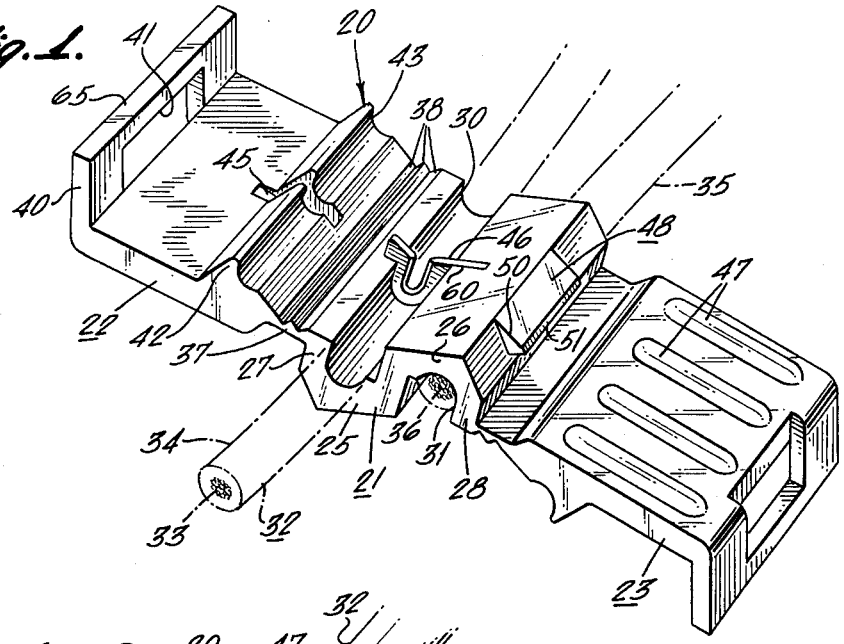
FIG. 1 is a perspective view of the connector showing both covers unlatched, with wires pushed within the pockets of the connector. The wires are shown in phantom.

A connector 20 has a body portion 21 and hinge covers 22 and 23. Body portion 21 is formed in an S-shaped cross section having a first bend 25 and a second bend 26 with ends of the S-shaped cross section at 27 and 28. The connector extends a suitable length longitudinally to provide a secure support for a wire, as will be explained. The connector may be, for instance a ½ inch length for connecting insulted wires of, for instance, 18 gauge. The connector is made of a polypropylene plastic or other suitable insulating material by, for instance, injection molding.

Each of the bends of the S, 25 and 26, form respective pockets, or grooves 30 and 31, of a cross-sectional size and shape to conform to the outside diameter of an insulated wire conductor 32. The wire 32 has therein a metallic strand or solid conductor element 33 and is covered by insulation 34, as is well known. Pocket 31 is of an identical shape and size to pocket 30 and conforms to the diameter of the insulated wire 35 having therein conductor 36.

Figure 2:
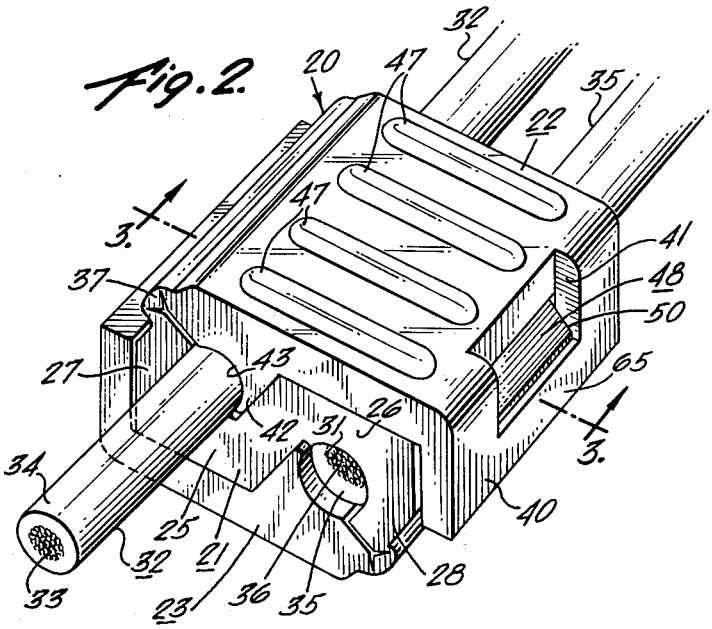
FIG. 2 is a perspective view of the closed connector of the invention showing the connector connecting two insulated wires.

Cover 22 is hinged at 37 to body 21 at end 27 of the S-shaped cross section. The hinge extends longitudinally along the body, and is formed integrally with the body, having interior ridges 38 whereby the cover can be readily pivoted without interference. Cover 22 is of a flat, rigid shape and has extending at right angles therefrom a U-shaped latch portion40 which has an internal opening 41 of rectangular shape. Cover 22 has formed on one surface a ridge 42 with a curvature 43 formed within the ridge. Curvature 43 conforms to the circumference of wire 32 as best seen in FIG. 2. A slot 45 extends transversely through ridge 42 at a position which will correspond to the location of a metallic contact plate 46 which is secured within body 21 as will be explained. Cover 22 is able to swing from an open position as is seen in FIG. 1 to a closed position as is seen in FIG. 2. Cover 22 has ridges 47 formed on its outside as seen in FIG. 2 in order to provide a corrugated surface for better gripping and strength during the connect and disconnect operation of the conductor. The number of ridges may vary.

Cover 23 is identical in construction to cover 22 except that it is pivoted or hinged to body 21 at end 28, and is intended to swing closed on the side of the S cross section opposite to the swing of cover 22.

Body 21 has formed thereon a triangular-shaped latch block 48 which has a beveled edge 50 and a base edge 51. The triangular-shaped latch block 48 extends longitudinally along the body for a length equivalent to the length of the opening 41 within covers 22 and 23. A triangular-shaped latch block 52 identical to latch block 48 is formed on the body on the bend of the S cross section opposite to the location of block 48.

Figure 3:
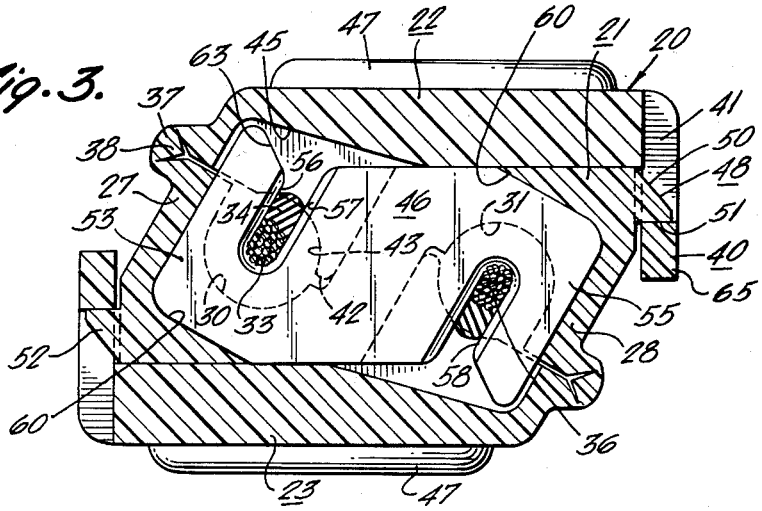
FIG. 3 is a cross-sectional view taken on the line 3—3 of FIG. 2.
Figure 4:
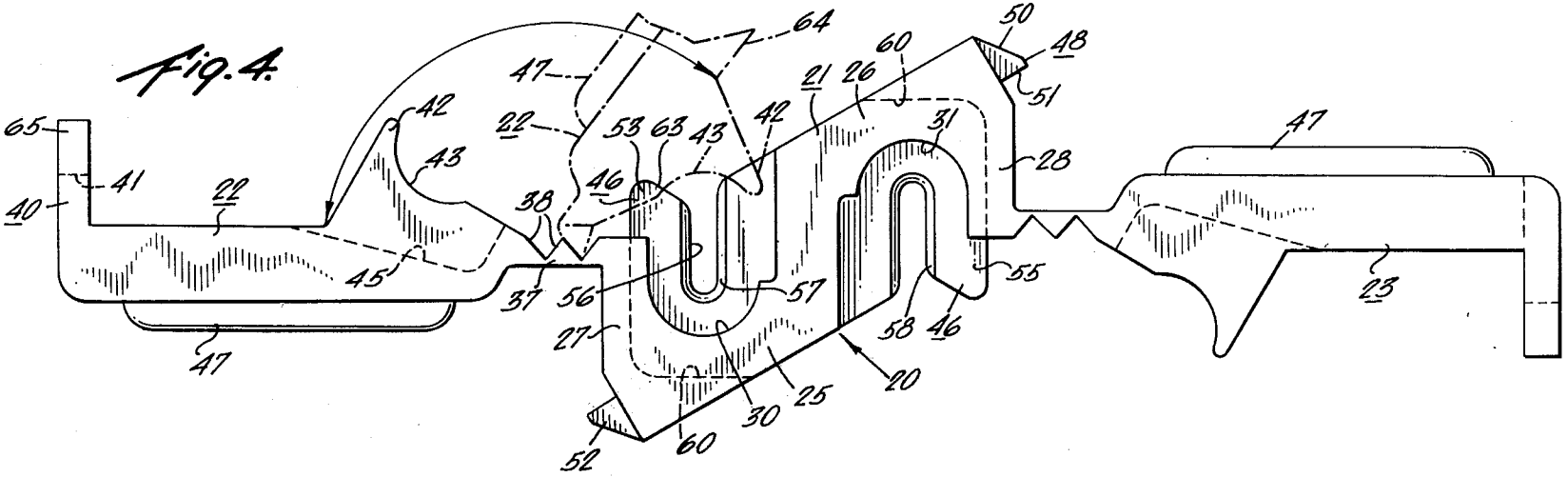
FIG. 4 is a side elevational view showing the connector in open position, with a hinged portion of the connector being shown in phantom in a closed position.

A metallic contact insert plate 46 of non-ferrous electrically-conductive metal, such as brass, extends within body 21 transverse to the connector. Insert 46 is positioned midway longitudinally within the connector. The insert plate as best seen in FIGS. 3 and 4 is of an S shape having a first portion at 53 and a second portion at 55. Within portion 53 there extends a slot 56, having edges 57 which may be sharpened or unsharpened. The slot is of a width adequate to receive wire conductors 33. Slot 58 within portion 55 is identical in construction to slot 56 except that it opens in a direction opposite to the opening of slot 56. Slots 56 and 58 extend parallel to one another.

Plate 46 is of a thickness adequate to insure stiffness and strength. Metallic contact plate 46 is held within body 21 of the connector in slot 60. The insert 46 is held in a secure position by a force fit.

The body 21, covers 22 and 23, blocks 48 and 52 are preferably formed integrally, by an injection molding process of polypropylene, or self-extinguishing nylon rated for 105° C. or other suitable insulating material. Openings 41 and slots 45 and 60 are formed in the covers during or subsequent to the injection molding process.

Figure 5:
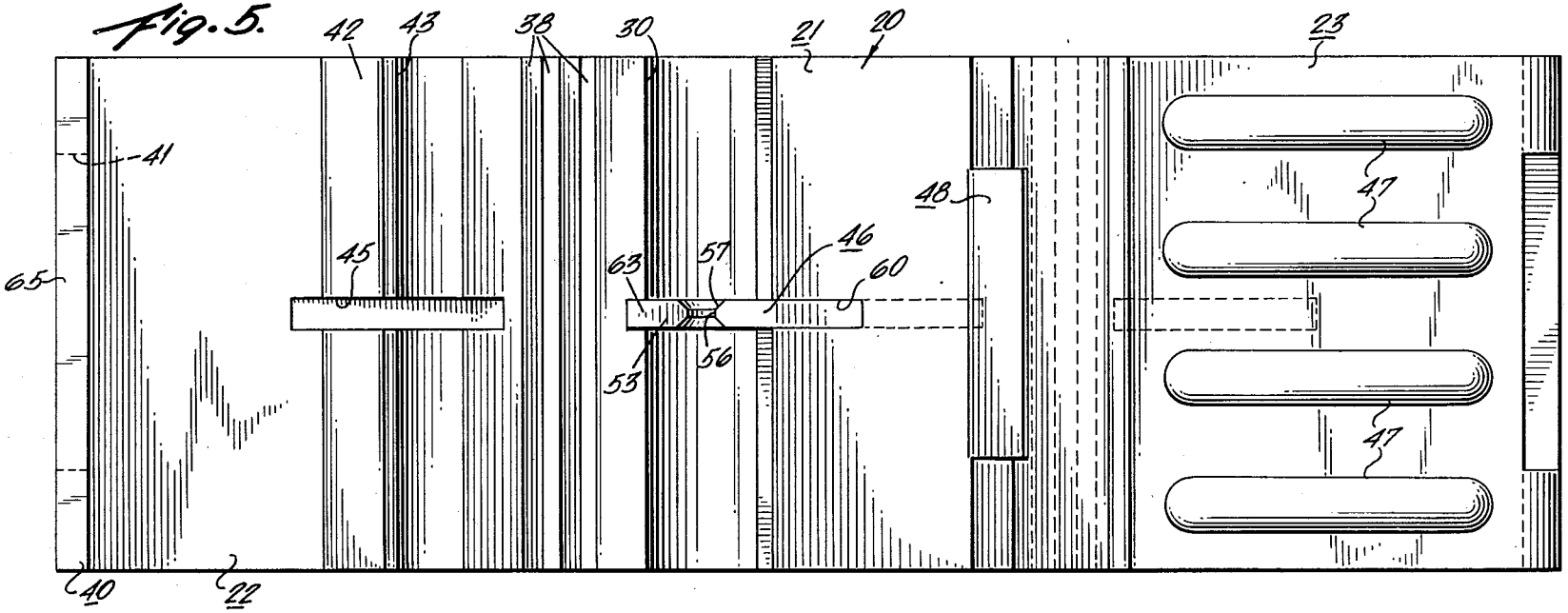
FIG. 5 is a plan view of FIG. 4.

In forming a connection, the covers 22 and 23 of the connector 20 are initially in an open position, as seen in FIGS. 1, 4 and 5. Wire 32 is laid into wire-receiving channel 30, in contact with plate 46 over slot 56. Plate 47 has a sloping shoulder 63 which guides the wire into slot 56. Wire 32 may terminate within body 21 of connector 20, or it may extend completely through, in endless fashion. A stop may be molded within the body in either groove 30 or 31, or both, which acts to position and block the wire within the channel. Such stops are well-known.

Cover 22 is then swung closed, by rotating cover 22 toward the body 21. Cover 22 is shown partially in phantom at 64 in FIG. 4. During the closing, curvature 43 will bear against wire 32 and force wire insulation 34 into slot 56, whereby edges 57 will be cut into insulation 34. Wire conductors 33 of wire 32 will come into contact with edges 57, forming an electrical contact. Cover 22, which is relatively rigid, is forced closed by the operator, either using his fingers or a tool such as pliers.

It will be seen that cover 22 acts as a lever, with a fulcrum at hinge point 37. The operator applies force to the lever on the outside of the cover along ridges 47. The point of application of force to the wire 32 is on the inside of the cover at curvature 43, which is close to the fulcrum point 37. It is apparent that the mechanical advantage achieved in the application of force is substantial.

When the cover 22 approaches its closed position as shown in FIGS. 2 and 3, U-shaped latch portion 40 springs outward under the influence of beveled edge 50 of latch block 48, until the portion 65 clears the block 48 to return to its relaxed position and engage stop 51. The cover 22 is then firmly secured in position as seen in FIGS. 2 and 3, and wire 32 is captured and securely retained in groove 30.

Wire 35 is then positioned in grooe 31, and cover 23 is then latched in a manner identical to that described with respect to cover 22 above.

During the disconnect operation, the above steps are reversed. The U-shaped latch portion 40 is pried outwardly to clear stop 51, and the cover 22 is lifted away from body 21. Wire 32 is then lifted from channel 30, out of contact with plate 46. One of, or both, wires 32 and 35 can be so disconnected.

In view of my invention and disclosure, variations and modifications to meet individual whim or particular need will doubtless become evident to others skilled in the art, to obtain all or part of the benefits of my invention without copying the structure shown; and I therefore claim all such insofar as they fall within the reasonable spirit and scope of my claims.

I claim:

1. A connector for insulated electrical wires comprising:

a. a body portion having an S-shaped cross section forming a wire-receiving channel at each interior bend of the S;

b. a cover hinged at each end of the S;

c. latch means for securing each cover in closed position; and d. a metal contact plate in the body portion extending into each channel.

2. A connector of claim 1 wherein the body portion, covers, and latch means are formed integrally of a polypropylene or other suitable insulating material.

* * * * *